US005527419A

United States Patent [19]

Vernon et al.

[11] Patent Number: 5,527,419

[45] Date of Patent: Jun. 18, 1996

[54] APPARATUS FOR THE PRODUCTION OF TAGGED ARTICLES

[75] Inventors: Geoffrey W. Vernon, Kenilworth; James Goodwin, Coventry; Andrew J. Cleall, Radford, all of Great Britain

[73] Assignee: Thomas J. Lipton Co., Division of Conopco, Inc., Englewood Cliffs, N.J.

[21] Appl. No.: 408,744

[22] Filed: Mar. 21, 1995

Related U.S. Application Data

[62] Division of Ser. No. 253,185, Jun. 2, 1994, abandoned, which is a continuation of Ser. No. 68,273, May 26, 1993, abandoned, which is a continuation of Ser. No. 801,324, Dec. 2, 1991, abandoned.

[30] Foreign Application Priority Data

Nov. 30, 1990 [GB] United Kingdom ..... 9026123

[51] Int. Cl.[6] ..... B65B 29/04; B65D 33/12

[52] U.S. Cl. ..... 156/446; 53/134.2; 156/443; 156/447; 156/516; 156/517; 156/519; 156/556; 156/566; 156/567; 156/568; 493/375

[58] Field of Search ..... 156/166, 252, 156/176, 292, 297, 443, 446, 447, 510, 516, 517, 519, 556, 566–568; 53/134.2, 413; 206/0.5, 806; 426/77, 79, 80, 83, 394, 82; 493/375

[56] References Cited

U.S. PATENT DOCUMENTS

| | | |
|---|---|---|
| 2,335,159 | 11/1943 | Salfisberg . |
| 2,556,383 | 6/1951 | Williams . |
| 2,925,171 | 2/1960 | Eaton . |

FOREIGN PATENT DOCUMENTS

| | | |
|---|---|---|
| 0448325 | 9/1991 | European Pat. Off. . |
| 2052428 | 1/1981 | United Kingdom . |
| 2202819 | 10/1988 | United Kingdom . |
| 9214649 | 9/1992 | WIPO . |

*Primary Examiner*—Jeff H. Aftergut
*Attorney, Agent, or Firm*—James J. Farrell

[57] ABSTRACT

A method and apparatus are described for tag and thread assembly for tagged infusion packets. Spaced tags from a strip of tags and a length of thread are laid over each other on the periphery of a first assembly wheel and the thread is drawn out in loops between successive tags. The spaced tags and looped thread are transferred to a second assembly wheel where they are connected to a web of sheet material that is to form the infusion packets. The web is subsequently formed into a series of compartments in which infusion material is contained. The compartments are severed from the web for forming the individual packets and the thread is simultaneously severed between the packets.

11 Claims, 4 Drawing Sheets

APPARATUS FOR THE PRODUCTION OF TAGGED ARTICLES

This is a Divisional of Ser. No. 08/253,185, filed Jun. 2, 1994, now abandoned, which is a continuation application of Ser. No. 08/068,273 filed on May 26, 1993, now abandoned, which is a continuation application of Ser. No. 07/801,324 filed on Dec. 2, 1991, now abandoned.

BACKGROUND OF THE INVENTION

This invention relates to tagged articles and to a method and apparatus for producing such articles. The invention finds particular, but not exclusive, use in the production of infusion packets containing infusible material, such as tagged tea bags.

Tea bags consist of doses of dried and shredded tea leaves, sealed in compartments made of a readily permeable web material, generally referred to as paper although it may have a significant plastics content and may even be constituted by a perforated or permeable plastics material. Tea bags and other infusion bags are often provided with a tag, attached to the bag itself through a thread, to make it more convenient for the user to handle the bag.

Examples of such tagged bags can be found in GB-A-2052428, U.S. Pat. No. 2,925,171 and U.S. Pat. No. 2,335,159. In the first of these, the thread is pre-packed within the tag and the tag is then inserted into a pocket in the bag itself. The arrangement is intended to avoid entangling the threads in a package of bags such as might happen if all the tags hung freely from their threads. The solution to that problem offered by the disclosure is, however very elaborate and increases costs very considerably.

U.S. Pat. No. 2,925,171 provides examples of infusion bags with freely hanging tags. The thread attaching the tag to its bag may be knotted onto the end of the bag, so also closing the bag but incidentally also restricting the volume of the bag when its contents swell during infusion. Alternatively, the thread must be attached to the bag by a staple or clip.

In the case of U.S. Pat. No. 2,335,159 one or more threads are laid between the two web layers that form the compartments of a series of bags and the compartments are separated from each other by seals across the webs in the regions where the threads cross the web. This form of product is difficult to manufacture—for example the threads must be correctly located between the webs before the infusible material can be sealed in place—and may not be particularly convenient since the length of the thread is set by the size of the bag.

Another method of producing tagged tea-bags is disclosed in U.S. Pat. No. 2,556,383 in which a thread is drawn onto a periphery of a rotating wheel on which there are a series of spaced tag seats. Tags having pre-punched flaps are then slid sideways into the seats over which the thread already runs, the thread being engaged by the flaps as the tags are inserted. The flaps are next pressed down onto the thread to secure the tags and thread together, and following this the thread between each adjacent pair of tags is drawn into a recess in the wheel to form a loop. The thread between successive tags is next cut as the tags are carried round to the bottom of the wheel. Here the loops of thread depend below the wheel and are attached to respective tea-bags which are conveyed below the wheel in synchronism with its rotation.

Such an arrangement provides a continuous production process but has many disadvantages. In particular, the tags cannot be very securely attached to the thread because they rely on the purely mechanical connection offered by the flaps, which must also allow the thread to be drawn through them when the loops are formed. There is also the difficulty of ensuring alignment between the loosely hanging loops and the bags passing beneath the wheel, which makes it impossible to achieve fast and reliable production.

SUMMARY OF THE INVENTION

It is an object of the invention to provide an alternative method of assembling tags to a thread, and/or assembling the tags to infusion packets with a thread between each tag and its packet. More generally, the invention is applicable to the attachments of tags by a thread (which term may include any filament-like element) to sheet materials of various forms.

According to one aspect of the invention, there is provided a method of attaching a thread to a tag in which a continuous length of the thread is brought together with a series of spaced tags and the thread between the tags is drawn out to a length greater than the spacing between the tags, characterised in that the thread is attached adhesively to the tag after said drawing out of the thread between succeeding tags.

In an alternative aspect of the invention there is provided a method of attaching tags and thread to a sheet material wherein a web of the sheet material is assembled with a series of tags spaced along its length, said thread having a length between successive tags greater than the spacing between the tags and at least a part of the surplus length of said thread being held between the tags and said web of sheet material. Preferably the attachment of each tag to the thread is made only after retaining the thread between tag and web.

According to another aspect of the present invention there is provided a tag-thread assembly apparatus having a circulatory working surface comprising a plurality of tag seats arranged to retain successive tags, means for laying a thread onto said surface coincident with the tags, loop formers between successive tag seats being engageable with the thread and displaceable for drawing the thread in a loop between each successive pair of seats, and means for attaching the thread to the tags after said loop-drawing step.

In one embodiment the working surface is provided on the circumference of a wheel, around which are spaced a series of tag seats provided with suction retaining means for the tags. Slots between the tag seats accommodate loop formers which reciprocate into and out of the slots, so as to draw into the slots a thread that extends freely over the tags on the working surface, thereby to form looped lengths of the thread between successive tag seats before the thread is attached to the tags.

The apparatus of the present invention may further include means for attaching the tags and looped thread to a web of sheet material. This may be effected by a second circulatory working surface, to which the tags and looped thread are transferred and onto which the sheet web material is introduced to lie against the tags and web, there being means associated with said second surface for attaching the web, tags and thread together.

In the assembly of tags and looped thread with the web of sheet material on the second working surface it is preferably arranged that at least part of the looped lengths of thread are gathered between their respective tags and the web.

Preferably the thread extends unbroken between successive tags during these assembly steps. The web will typically be divided subsequently, at intervals along its length, to form separate packets each with a tag, after some further treatment, for example to produce sealed compartments in the web bags, and the thread can be severed simultaneously with the severing of the compartments from the web.

The invention will now be described by way of example and with reference to the accompanying drawings.

BRIEF DESCRIPTION OF THE DRAWINGS

FIGS. 2*a* and 2*b* are, respectively, detail views of the application of the web to the tags and thread on the second assembly wheel and the combined web tags and thread leaving said wheel;

DESCRIPTION OF THE PREFERRED EMBODIMENT

Figure 1:
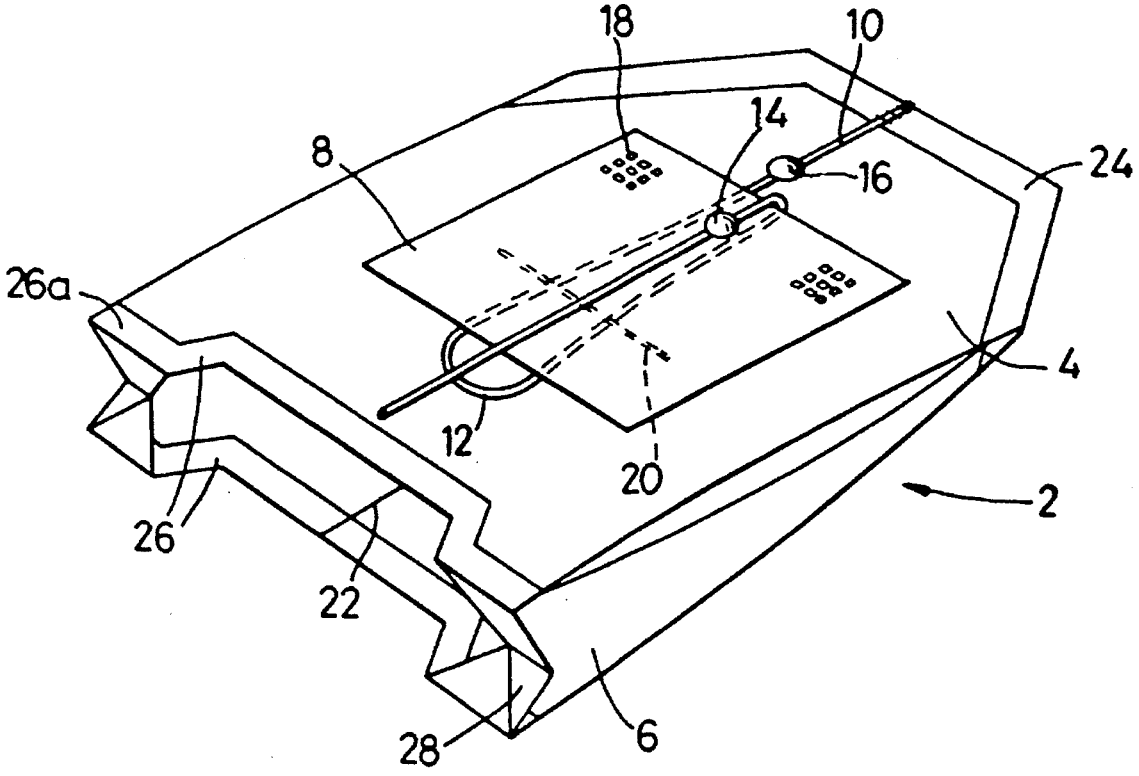
FIG. 1 is an oblique view of a tea bag carrying a tag and looped thread assembly produced using the present invention.

FIG. 1 shows a tea-bag 2 which comprises first and second compartments 4,6, each containing a dose of tea. A tag 8 is attached to the tea-bag and a thread 10, comprising a length gathered in a loop 12 held under the tag, is secured at one end to the tag by a glue spot 14 and at the other to the head or top of the tea bag by a glue spot 16. The tag is held releasably in place on the tea-bag by a pair of tacking heat seals 18 and a third such tacking seal 20 may be made to retain the thread loop in place.

The compartments 4,6 have each been produced from a web of sheet material folded lengthwise to form an elongate tube about the tea doses. The material has a fusible component for heat sealing and overlapping edges of the tube are closed together by a butt or lap seal 22. The seals 22 run along the opposed or inner faces of the two compartments of the tea-bag. The head and tail of each compartment are closed by profiled heat seals 24,26 respectively. These profiled seals are complementary to each other, the head seal 24 being convex and the tail seal 26 being concave. The heads of the two compartments are sealed together by the seal 24 which extends right across the width of the tea-bag. The thread 10 is secured at one end to this head seal. The concave heat seals 26 close the tails of the two compartments and form tapered side pieces at the tail of each compartment. The end tips of the side pieces of the two compartments are sealed together by further heat seals 26*a* juxtaposed on the seals 26 in this region and the joined side pieces are folded inwards so that in side view the tea-bag shows a W-fold 28 at the tail.

Figure 2:
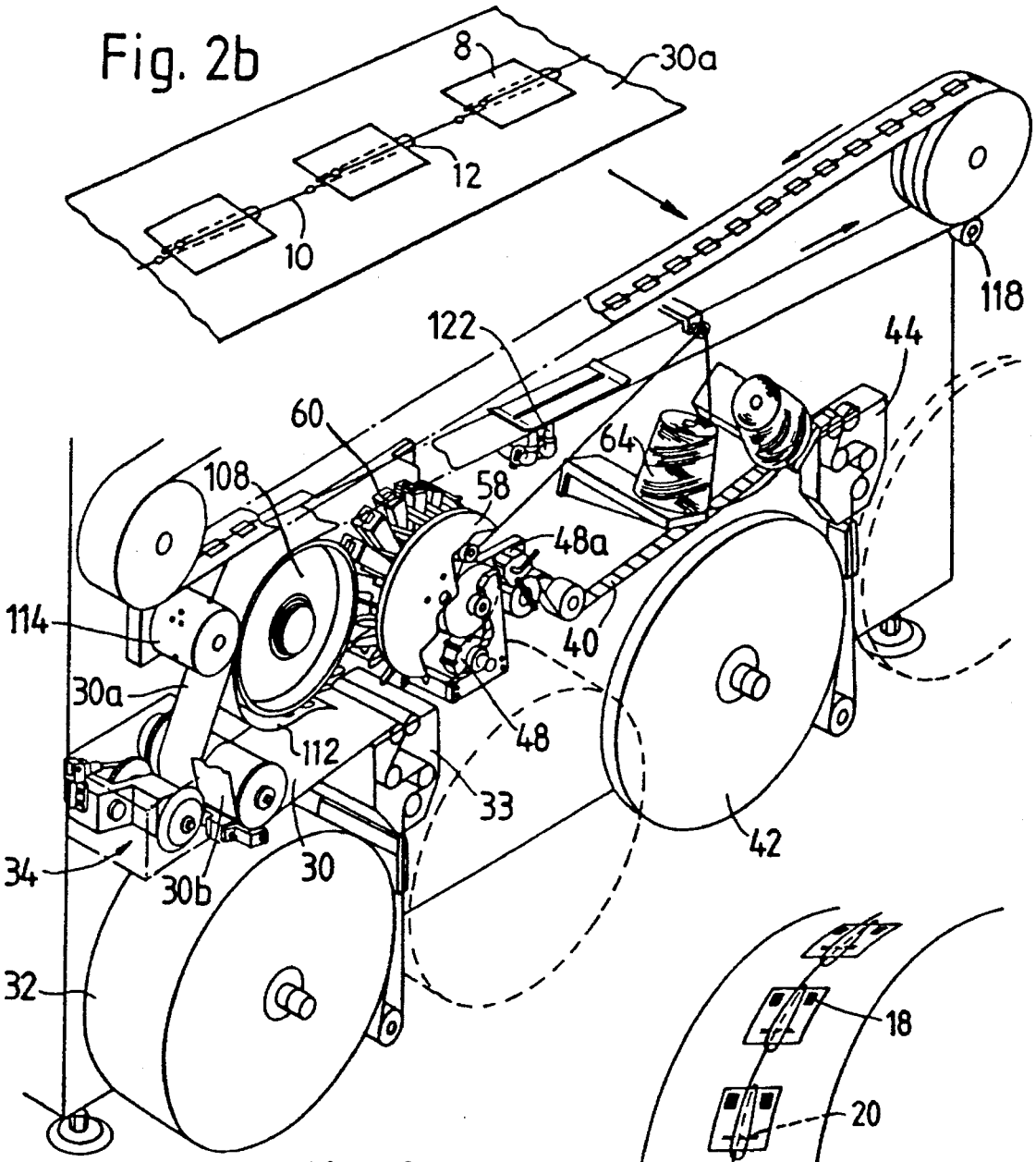
FIG. 2 is a simplified oblique view of a tag and thread assembly apparatus according to one embodiment of the present invention.
Figure 2A:
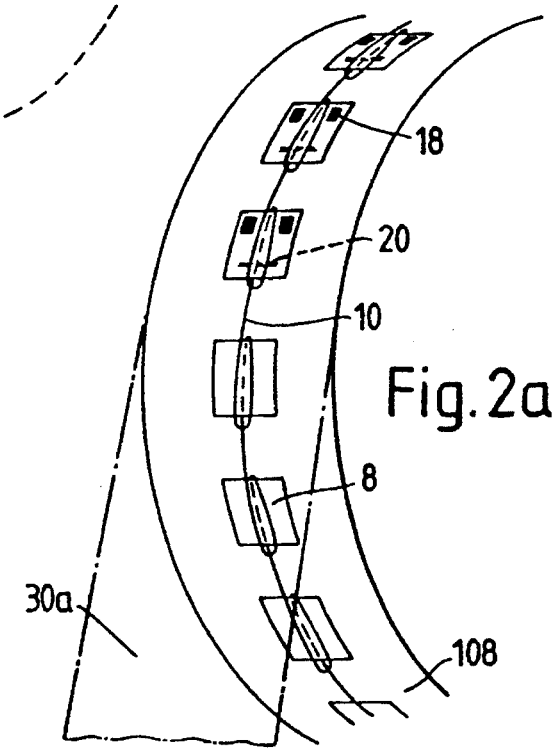

A continuous process may be operated to form the webs into double-compartment tea bags of this form, using the machine illustrated in our published European patent application A-448325, the contents of which are incorporated herein by reference. As is described in more detail in that earlier application, and as is shown in FIG. 2, a suitably permeable paper web 30 having heat sealing properties, for example a 15.5 gsm double-sided heat-sealable filter paper made by Messrs J. R. Crompton of Bury, Lancashire and known as "Single Phase Superseal", is drawn from roll 32 into a buffer reservoir 33.

Leaving the reservoir the web 30 is slit lengthwise into two webs 30*a*,30*b* as it passes through a pair of scissors rolls 34. The two webs are subsequently formed into respective series of sealed compartments containing doses of tea, and are brought together to give the double-compartment tea bags. Details of this process are given in the earlier application EP-A-448325, but the present application is primarily concerned with the assembling of the tags 8 and thread 10 with the web 30*a* before the web is dosed with tea and compartmented.

Figure 3:
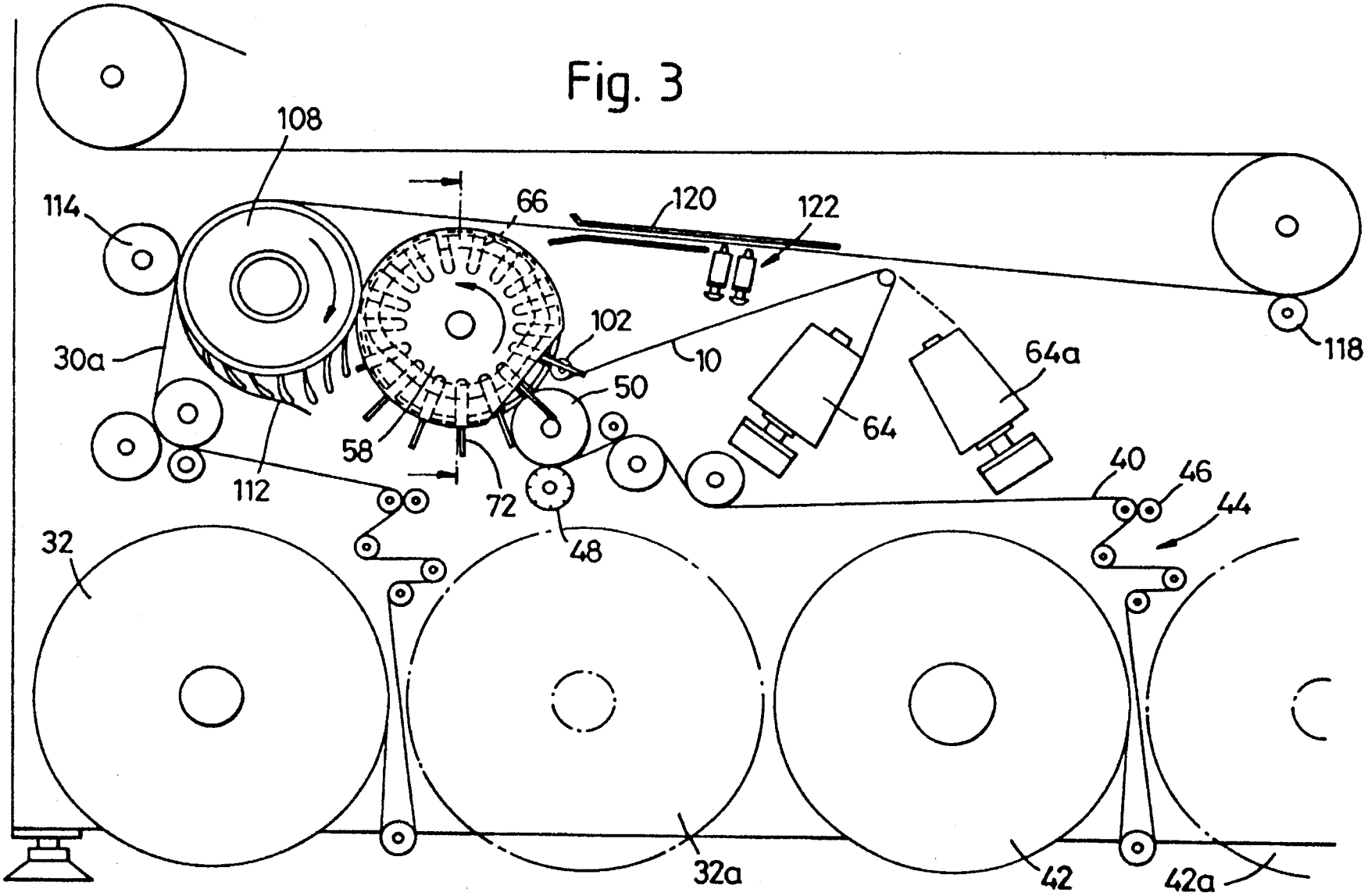
FIG. 3 is a schematic illustration of the assembly process using the apparatus of FIG. 3.

As shown in FIGS. 2 and 3, a tag strip 40 is drawn from a roll 42 through a reservoir 44 by a tag drive roller 46 to be fed to a tag cutter rotor 48 having a series of radial blades which operate against a counter-rotating pressure roller 50 to sever individual tags 8 from the strip 40. Sensing means 48*a* detect a pattern repeat printed on the tag strip to ensure the cuts of the cutter rotor are correctly located in relation to the pattern repeat. The pressure roller 50 is provided with suction slots which are not shown but which are arranged and operated similarly to the suction slots in rotating assembly wheel 58 to which the pressure roller transfers the tags.

Figure 5:
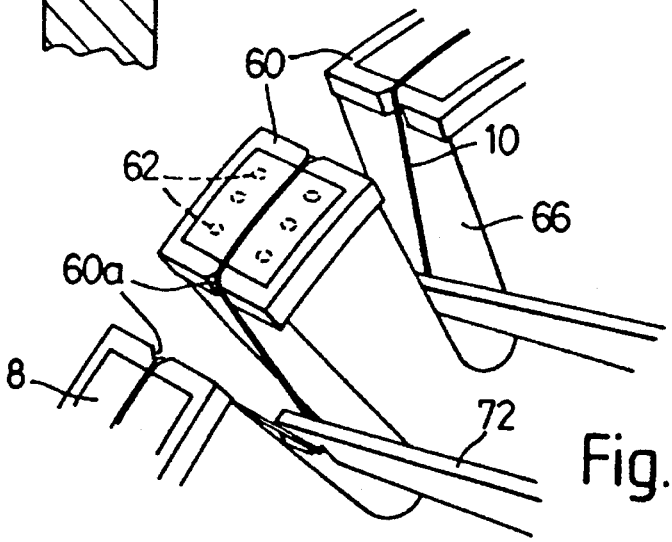
FIG. 5 is a detail illustration of tag seats on the first assembly wheel.

As each tag 8 is severed from the strip 40 it is retained by suction on the roller 50 which carries the tag to the periphery of the assembly wheel 58 which has on its periphery a series of spaced seats 60 for individual tags 8. Suction slots 62 (FIG. 5) open onto the face of each seat to hold the tags in place. The assembly wheel 58 runs faster than the pressure roller 50 so that the tags 8 are spaced from each other as they are delivered to the seats 60 on the wheel periphery. As each tag reaches a seat 60, the suction source switches from its sector on the roller 50 to the slots in that seat so that the tag is transferred from the roller to the assembly wheel seat.

At the same time, the thread 10 is drawn from a bobbin 64 onto the periphery of the wheel 58, to lie centrally on top of the tags 8. Between adjacent suction seats 60 the wheel 58 has radial slots 66 to permit the loops 12 to be formed in the thread between the tags.

Figure 4:
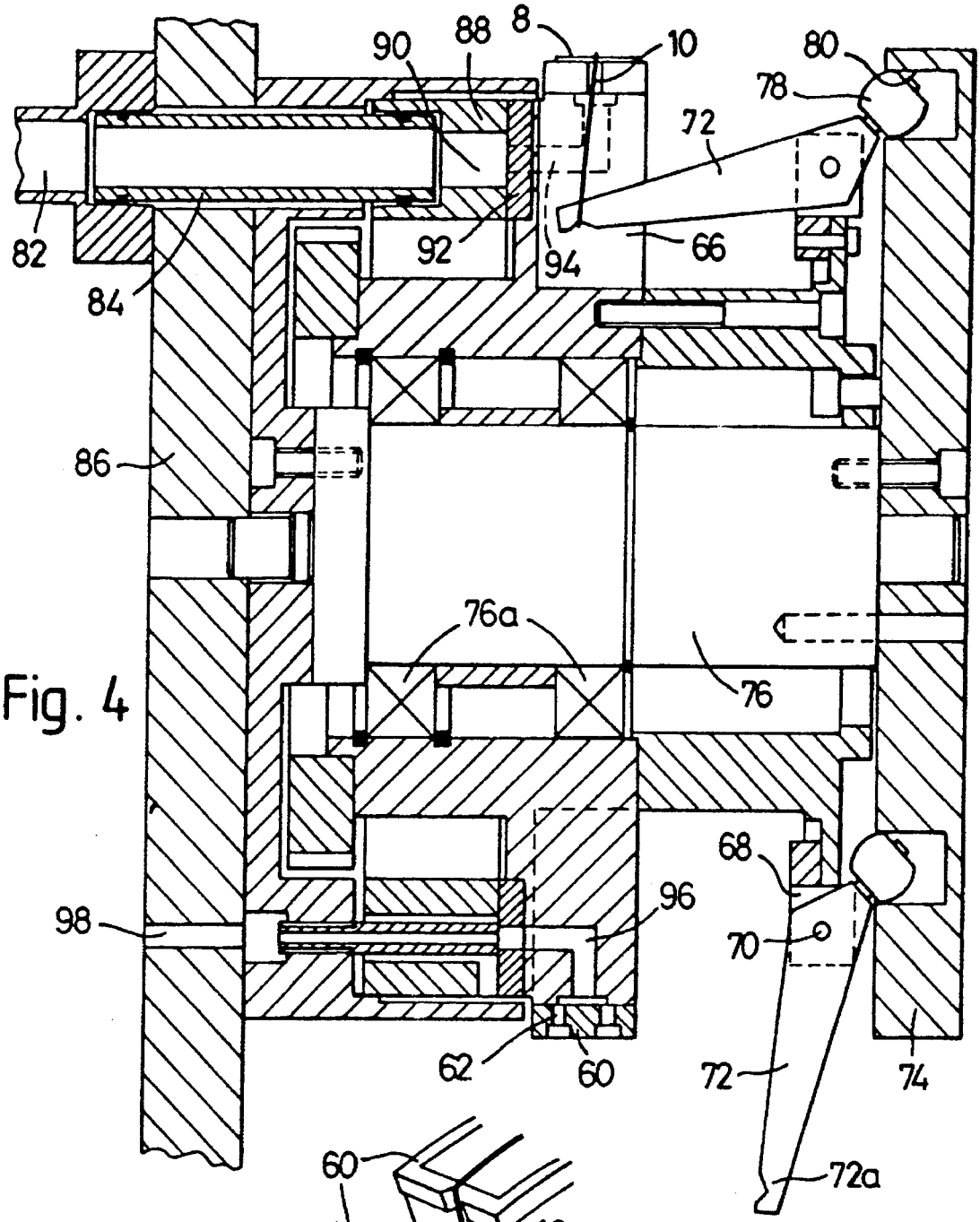
FIG. 4 is a diagrammatic sectional view of the first assembly wheel in the apparatus of FIG. 2.

To form the loops, on one side of the assembly wheel 58 an end flange 68 (FIG. 4) carries a series of pivot mountings 70 the axes of which are normal to the wheel axis. A series of arms 72 are supported in the pivot mountings 70 and each arm is aligned with a respective slot 66 to reciprocate about its pivot 70 into the slot so as to draw out the thread into a loop. In FIG. 4 respective arms 72 are illustrated at the opposite end positions of their reciprocating motion. The operating mechanism to generate this motion comprises a fixed cam plate 74 supported on an arbour 76 on which the assembly wheel 58 is rotatably supported through bearings 76*a*. On one end of each arm 72, a rolling follower 78 is mounted. Each follower 78 has a spherical sector outer surface that runs in a cam groove 80 extending continuously around the face of the cam plate 74. As the assembly wheel 58 rotates, therefore, the followers 78 track around the cam groove to reciprocate the other ends of their arms 72 into and out of the slots 66 in a pattern of movement determined by the fixed cam plate 74.

FIG. 4 also illustrates the suction supply to the seats 60 on the assembly wheel. Suction supply pipe 82 is connected to a junction piece 84 mounted in a fixed wall 86 on which the arbour 76 is supported. A manifold plate 88 is sealingly connected to the junction piece and has a suction channel 90 extending in an arc concentric to the assembly wheel. The manifold plate 88 bears on a sliding seal plate 92 carried by the assembly wheel 58, the plate having a series of ports 94 aligned with conduits 96 which extend to the suction slots 62 in the tag seats 60. When the assembly wheel rotates, therefore, the slots 62 are subjected to suction as their respective ports 94 come into communication with the arcuate channel 90. Also shown in FIG. 4 is a similar arrangement, circumferentially spaced from the manifold 88, comprising an inlet 98 for connection to a pressure source (not shown) when it is required to blow through the conduits 96 and slots 62 to expel foreign matter.

In the sequence of operation, immediately after being transferred to the assembly wheel 58, each tag 8 passes under an idler roller 102 around which the thread 10 is guided onto the middle of the wheel. Over the sector of the assembly wheel in which the tags and thread are placed onto its periphery, the arms 72 are held in their outermost positions, clear of the slots 66 and the seats 60. When they reach the point at which the thread is laid onto the assembly wheel each arm 72 begins to swing radially inwards to catch the thread in its notched end 72*a* and draw a loop of thread into the associated slot 66. Central notches 60*a* at the opposite ends of each tag seat 60 help to keep the thread centred on the assembly wheel.

The loops have been fully formed by the time their respective slots 66 approach the periphery of a second assembly wheel 108 which is provided with analogous suction seats (not shown) to those on the first assembly wheel 58. The tags and thread are transferred to the second wheel 108 as the tag seats of the respective wheels come into register with each other, the suction effect then being switched from the tag seat on the wheel 58 to the tag seat on the wheel 108. As a result of the transfer the thread finds itself held between the tags and their seats where it is trapped with the loops formed between the tags hanging loosely.

To prevent the thread loops being trapped in the slots 66 during transfer to the second wheel the arms 72 rise from that lowermost position as they approach the second wheel but move out of the slots 66 only after they have passed the contact point with the second wheel. In fact, by keeping the arms in the slots during the approach to the second wheel and after the drawing out of the loops and the approach to the second wheel for a minimum number of slots, eg. 6 slots, it can be ensured that the previously looped thread is held frictionally against return movement as each new loop is formed.

While on the second wheel the tags and thread are brought together with the web 30*a*. As they come towards the web, the loops are constrained to lie approximately centrally on the wheel periphery by suction means, eg. in the form of converging guide plate 112 having perforations (not shown) along its length connected to the suction source. Alternatively it may be arranged that a guide member such as the plate 112 exerts sufficient friction to draw the loops to near their full length.

Once the tags, thread and web have been brought together on the wheel 108, welding elements on a tacking roller 114 form the weak heat seals 18,20 between the tags and the web. The seals 18 are made by a pair of small heated elements bearing on the tag on each side of the central thread the elements having a grid-like surface so that high local pressures are applied without creating large forces, and the fusible component of the web material is reliably softened or melted to adhere to the tag. A further heated element on the tacking roller is in the form of a narrow heated bar to make the tack seat 20 between the thread loop to the web.

After leaving the second wheel, the assembly is drawn onwards by a further nip drive roller 118 which runs at a slightly higher speed to maintain a slight tension in the web between the second wheel 108 and the drive 118. The tension ensures that the tags can be kept in register as the assembly passes through a shielded section 120 over a pair of hot melt jetting guns 122 which produce the spot seals 14,16 securing the thread to the tag and to the web respectively.

It is also possible to use a heat-sealable thread to make the thread-web and/or thread-tag connections.

As described previously, although the assembly of the threaded tags to the web is now completed, the thread is left in a continuous length as the web is processed further. The thread is severed only at the final stage when the tea bags have been fully formed, simultaneously with the severing of the bags from each other. For further illustration of that step reference may be made to EP-A-448325 referred to above.

FIG. 2 also shows, in broken lines, reserve spools 32*a*, 42*a*,64*a* of web, tag and thread materials for ensuring continuity of operation.

We claim:

1. A tag-thread assembly apparatus comprising a circulatory working surface having a plurality of tag seats on said surface for retaining successive tags thereon, loop formers between successive said tag seats for drawing a thread in a loop between each successive pair of seats, a guide device for laying the thread onto said surface coincident with the tags, a control arrangement for placing the thread loops over the tags and a securing device, for attaching the thread to the tags after said loop-drawing step.

2. Apparatus according to claim 1 wherein a wheel member has a circumference providing said circulatory working surface, said series of tag seats being arranged on said circumference, suction retaining means for the tags being provided on said tag seats.

3. Apparatus according to claim 1 further comprising means for attaching the tags and looped thread to a web of sheet material.

4. Apparatus according to claim 3 wherein said means for attaching the tags and loop thread to a web of sheet material comprises a second circulatory working surface for receiving the spaced tags and the looped thread from the first said working surface, and means for introducing onto said second circulatory surface the web of sheet material to lie against the tags and thread, there being means for cooperation with the web, tags and thread on said second surface for at least temporarily attaching the assembly of web, tags and thread together while they are on said surface.

5. Apparatus according to claim 3 wherein said means for attaching the thread to the tags and said means for attaching the assembly of web, tags and thread together are discrete from, said means for attaching the thread to the tags and act to releasably attach the web, tags and thread together before said means for attaching the thread to the tags.

6. Apparatus according to claim 3 further comprising means for collecting at least part of the looped lengths of thread to lie generally centrally to the tags and between the tags and the web.

7. A tag-thread assembly apparatus comprising a circulatory working surface having a plurality of tag seats on said surface for retaining successive tags thereon, loop formers between successive said tag seats for drawing a thread in a loop between each successive pair of seats, means for laying the thread onto said surface coincident with the tags, a transporting and guiding arrangement for bringing the tags and looped thread together with a web of sheet material and means for attaching the tags and looped thread to said web with said thread loops held between the tags and the web.

8. Apparatus according to claim 7 wherein said transporting and guiding means comprises a second circulatory working surface for receiving the tags and the looped thread from the first said working surface, said second circulatory surface receiving the web of sheet material to lie against the tags and thread, said attaching means at least temporarily attaching the assembly of web, tags and thread together while they are on said surface.

9. A tag-thread assembly apparatus comprising a circulatory working surface, a plurality of tag seats on said surface for retaining successive tags thereon, means for laying a thread onto said surface coincident with the tags on said seats, loop formers between successive said tag seats movable generally transversely to the plane of said seats for drawing a thread in a loop between each successive pair of seats, and means for attaching the thread to the tags after said loop-drawing step.

10. Apparatus according to claim 9 having means for attaching the tags and looped thread to a web of sheet material, said means comprising a second circulatory working surface for receiving the tags and the looped thread from the first said working surface, said second circulatory surface receiving the web of sheet material to lie against the tags and thread, there being means for cooperation with the web, tags and thread on said second surface for at least temporarily attaching the assembly of web, tags and thread together while they are on said surface.

11. A tag-thread assembly apparatus comprising a first circulatory working surface having a plurality of tag seats on said surface for retaining successive tags thereon, a guide device for laying a thread onto said surface coincident with the tags, loop formers between successive said tag seats for drawing a thread in a loop between each successive pair of seats, a second circulatory working surface for receiving the tags and the looped thread from the first said working surface, means for introducing onto said second circulatory surface a web of sheet material to lie against the tags and thread, and means for cooperation with the web, tags and thread on said second surface for at least temporarily attaching the assembly of web, tags and thread together while they are on said surface.

* * * * *